US011214941B2

(12) United States Patent
Saitoh et al.

(10) Patent No.: US 11,214,941 B2
(45) Date of Patent: Jan. 4, 2022

(54) CONSTRUCTION MACHINE

(71) Applicant: HITACHI CONSTRUCTION MACHINERY CO., LTD., Tokyo (JP)

(72) Inventors: Teppei Saitoh, Mito (JP); Kenji Hiraku, Kasumigaura (JP); Mitsuo Aihara, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/253,187

(22) PCT Filed: Mar. 28, 2019

(86) PCT No.: PCT/JP2019/013836
§ 371 (c)(1),
(2) Date: Dec. 17, 2020

(87) PCT Pub. No.: WO2020/194730
PCT Pub. Date: Oct. 1, 2020

(65) Prior Publication Data

US 2021/0262201 A1 Aug. 26, 2021

(51) Int. Cl.
*E02F 9/22* (2006.01)
*F15B 11/08* (2006.01)

(52) U.S. Cl.
CPC ..... *E02F 9/2235* (2013.01); *E02F 9/2267* (2013.01); *E02F 9/2296* (2013.01); *F15B 11/08* (2013.01)

(58) Field of Classification Search
CPC ..... F15B 11/08; F15B 2211/20523; F15B 2211/20576; F15B 2211/20515; E02F 9/2296; E02F 9/2285; E02F 9/2242
See application file for complete search history.

(56) References Cited

U.S. PATENT DOCUMENTS

2018/0106018 A1 4/2018 Hoshino et al.
2018/0305899 A1* 10/2018 Kawaguchi ..... F02D 41/021
2019/0112789 A1* 4/2019 Fukuda ..... F04B 49/22

FOREIGN PATENT DOCUMENTS

JP 5-125746 A 5/1993
JP 2002-89506 A 3/2002
(Continued)

OTHER PUBLICATIONS

International Search Report (PCT/ISA/210) issued in PCT Application No. PCT/JP2019/013836 dated Jul. 2, 2019 with English translation (four (4) pages).
(Continued)

*Primary Examiner* — Abiy Teka
*Assistant Examiner* — Daniel S Collins
(74) *Attorney, Agent, or Firm* — Crowell & Moring LLP

(57) ABSTRACT

It is an object of the present invention to provide a construction machine having a good engine starting property in a low temperature environment.
The construction machine of the present invention includes: an electric pump having a delivery port connected to a line part of a pilot line, the line part connecting a pilot pump with a pilot control valve; a motor that drives the electric pump; and a temperature sensor that measures a temperature of a hydraulic working fluid delivered from the pilot pump. A controller starts driving of the motor in the case where a key switch is operated from a key OFF state to a key ON state and where the temperature of the hydraulic working fluid measured by the temperature sensor is lower than a predetermined temperature.

4 Claims, 10 Drawing Sheets

(56) References Cited

FOREIGN PATENT DOCUMENTS

| | | | |
|---|---|---|---|
| JP | 2010-107009 | A | 5/2010 |
| JP | 2014-227949 | A | 12/2014 |
| JP | 2015-48899 | A | 3/2015 |
| WO | WO 2017/154220 | A1 | 9/2017 |

OTHER PUBLICATIONS

Japanese-language Written Opinion (PCT/ISA/237) issued in PCT Application No. PCT/JP2019/013836 dated Jul. 2, 2019 (four (4) pages).

* cited by examiner

<PRIOR ART EXAMPLE>

CONSTRUCTION MACHINE

TECHNICAL FIELD

The present invention relates to a construction machine such as a hydraulic excavator on which is mounted a hydraulic drive system for driving a hydraulic actuator.

BACKGROUND ART

In recent years, in the construction machines such as hydraulic excavators and wheel loaders, energy saving of a hydraulic system has come to be an important item of development. In general, energy consumption of a hydraulic pump is desired to be suppressed at non-operating stand-by times. However, since a variable displacement swash plate type piston pump (hereinafter referred to as a one-side tilting pump) used for the hydraulic pump has a minimum delivery rate (hereinafter referred to as a minimum delivery rate), and delivers a hydraulic working fluid even when a delivery control command value is zero, the hydraulic pump consumes energy at stand-by time. Therefore, an unloading valve for relieving the minimum delivery rate to the tank at stand-by time of the excavator is provided, whereby energy consumption is suppressed. Since the unloading valve requires a large force for driving, the unloading valve cannot be composed of a solenoid valve but is composed of a control valve which is driven by a pilot pressure. Therefore, the unloading valve has a characteristic that the opening thereof is delayed at the time of a low temperature. This is because the viscous friction of the hydraulic working fluid is increased at a low-temperature time and, therefore, a rise in the pilot pressure is delayed.

For this reason, when it is intended to start an engine of a hydraulic excavator in a below-freezing environment, for example, at −10° C., the opening of the unloading valve is delayed. Therefore, the minimum delivery rate of the hydraulic pump cannot be relieved to the tank, the pressure inside a line rises, and pump load is raised. As a result, a problem that an engine starting property at a low-temperature time is lowered is generated such as engine load becoming excessively large or the engine stalling and stopping (engine stall)

In Patent Document 1, in an unloading circuit at the time of starting at a low temperature, a circuit for lowering a set pressure of a main relief valve to below a pressure normally used at the engine starting time is described, separately from the unloading valve the operation of which is delayed at a low temperature. As a result, since the minimum delivery rate of the hydraulic pump is discharged to the tank through the main relief valve separately from the unloading valve at the engine starting time, the engine can be started without raising the hydraulic pump load.

PRIOR ART DOCUMENT

Patent Documents

Patent Document 1: JP-2010-107009-A
Patent Document 2: JP-2015-048899-A

SUMMARY OF THE INVENTION

Problems to be Solved by the Invention

On the other hand, in a large-type hydraulic excavator described in Patent Document 2, the number of hydraulic pumps is increased to 6 to 12 times, as compared to the hydraulic excavator described in Patent Document 1. Therefore, when the technology described in Patent Document 2 for improving the low-temperature starting property is applied to the respective unloading valves and main relief valves which should be provided on a hydraulic pump basis, cost increases. In addition, since the number of lines for controlling set pressures of the main relief valves increases, mountability is lowered.

The present invention has been made in consideration of the above-mentioned problems. It is an object of the present invention to provide a construction machine capable of enhancing an engine starting property in a low temperature environment at low cost.

Means for Solving the Problems

In order to achieve the above object, the present invention provides a construction machine including: an engine; a variable displacement hydraulic pump driven by the engine; a hydraulic actuator; a selector valve capable of establishing and interrupting of communication of a line connecting the hydraulic pump with the hydraulic actuator; an unloading valve that is provided in a line branched from a delivery line of the hydraulic pump and connecting to a tank and that is opened according to a pilot pressure acting on a pilot pressure receiving section; a pilot pump driven by the engine; a pilot control valve that is provided in a pilot line connecting a delivery port of the pilot pump with the pilot pressure receiving section and that controls the pilot pressure acting on the pilot pressure receiving section; a controller that controls opening of the pilot control valve; and a key switch capable of being switched between a key OFF state, a key ON state for giving an instruction about starting of the controller, and an engine ON state for giving an instruction about starting of the engine, the controller opening the pilot control valve in case the key switch is operated from the key OFF state to the key ON state. The construction machine includes: an electric pump having a delivery port connected to a line part of the pilot line, the line part connecting the delivery port of the pilot pump with the pilot control valve; a motor that drives the electric pump; and a temperature sensor for measuring a temperature of a hydraulic working fluid delivered from the pilot pump, and the controller starts driving of the motor in case the key switch is operated from the key OFF state to the key ON state and the temperature of the hydraulic working fluid measured by the temperature sensor is lower than a predetermined temperature.

According to the present invention configured as above, the pilot line is raised in pressure by the electric pump when the key switch is in the key ON state in a low temperature environment, and, therefore, the unloading valve is opened before the key switch is operated to the engine ON state. This ensures that, from immediately after the key switch is operated to the engine ON state, the hydraulic working fluid in the minimum delivery rate delivered from the one-side tilting pump is discharged to the tank through the unloading valve. As a result, an increase in pump load before stabilization of the engine rotational speed is restrained, thus the engine 9 can be started stably.

In addition, even in a case where a plurality of one-side tilting pumps are mounted, the electric pump and the motor corresponding to the respective unloading valves can be used in common, thus an engine starting property in a low temperature environment can be enhanced at low cost.

Advantages of the Invention

According to the construction machine according to the present invention, an engine starting property in a low temperature environment can be enhanced at low cost.

MODES FOR CARRYING OUT THE INVENTION

Figure 1:
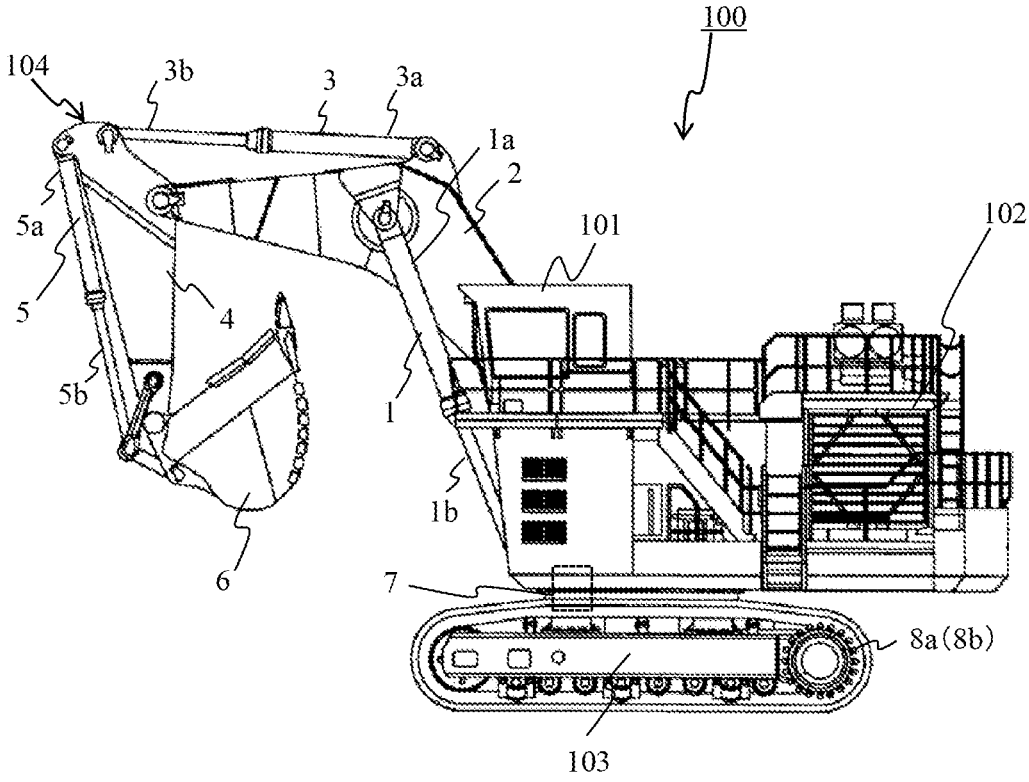
FIG. 1 is a side view depicting a hydraulic excavator according to a first embodiment of the present invention.

A construction machine according to an embodiment of the present invention will be described below taking a large-type hydraulic excavator as an example thereof and referring to the drawings. Note that, in the drawings, equivalent elements are denoted by the same reference characters, and overlapping descriptions thereof will be omitted, as required.

Embodiment 1

FIG. 1 is a side view depicting a hydraulic excavator according to a first embodiment of the present invention.

The hydraulic excavator 100 includes: a lower track structure 103 having crawler type track devices 8*a* and 8*b* on respective left and right sides; and an upper swing structure 102 as a machine main body swingably mounted on the lower track structure 103. The upper swing structure 102 is driven to swing relative to the lower track structure 103 by a swing motor 7 as a swing hydraulic motor.

To the front side of the upper swing structure 102, a front work implement 104 as a work device for performing, for example, excavation is mounted in a vertically rotatable manner. Here, the front side refers to the direction in which an operator riding in a cab 101 faces (the leftward direction in FIG. 1).

The front work implement 104 has a boom 2, an arm 4, and a bucket 6. A base end portion of the boom 2 is connected to the front side of the upper swing structure 102 in a vertically rotatable manner. A base end portion of the arm 4 is connected to a tip portion of the boom 2 in a vertically or front-rear directionally rotatable manner. The bucket 6 is connected to a tip portion of the arm 4 in a vertically or front-rear directionally rotatable manner. The boom 2 is driven by a boom cylinder 1, which is a single rod type hydraulic cylinder. The arm 4 is driven by an arm cylinder 3, which is a single rod type hydraulic cylinder. The bucket 6 is driven by a bucket cylinder 5, which is a single rod type hydraulic cylinder. The boom cylinder 1 has a tip portion of a cylinder head 1*b* connected to the upper swing structure 102, and has a base end portion of a cylinder head 1*a* connected to the boom 2. The arm cylinder 3 has a tip portion of a cylinder rod 3*b* connected to the arm 4, and has a base end portion of a cylinder head 3*a* connected to the boom 2. The bucket cylinder 5 has a tip portion of a cylinder rod 5*b* connected to the bucket 6, and has a base end portion of a cylinder head 5*a* connected to the arm 4.

On the upper swing structure 102, the cab 101 is provided as an operation room in which the operator rides. An operating lever 36 (depicted in FIG. 2) as an operating member for operating the boom 2, the arm 4 and the bucket 6 constituting the front work implement 104 is disposed in the cab 101.

Figure 2:
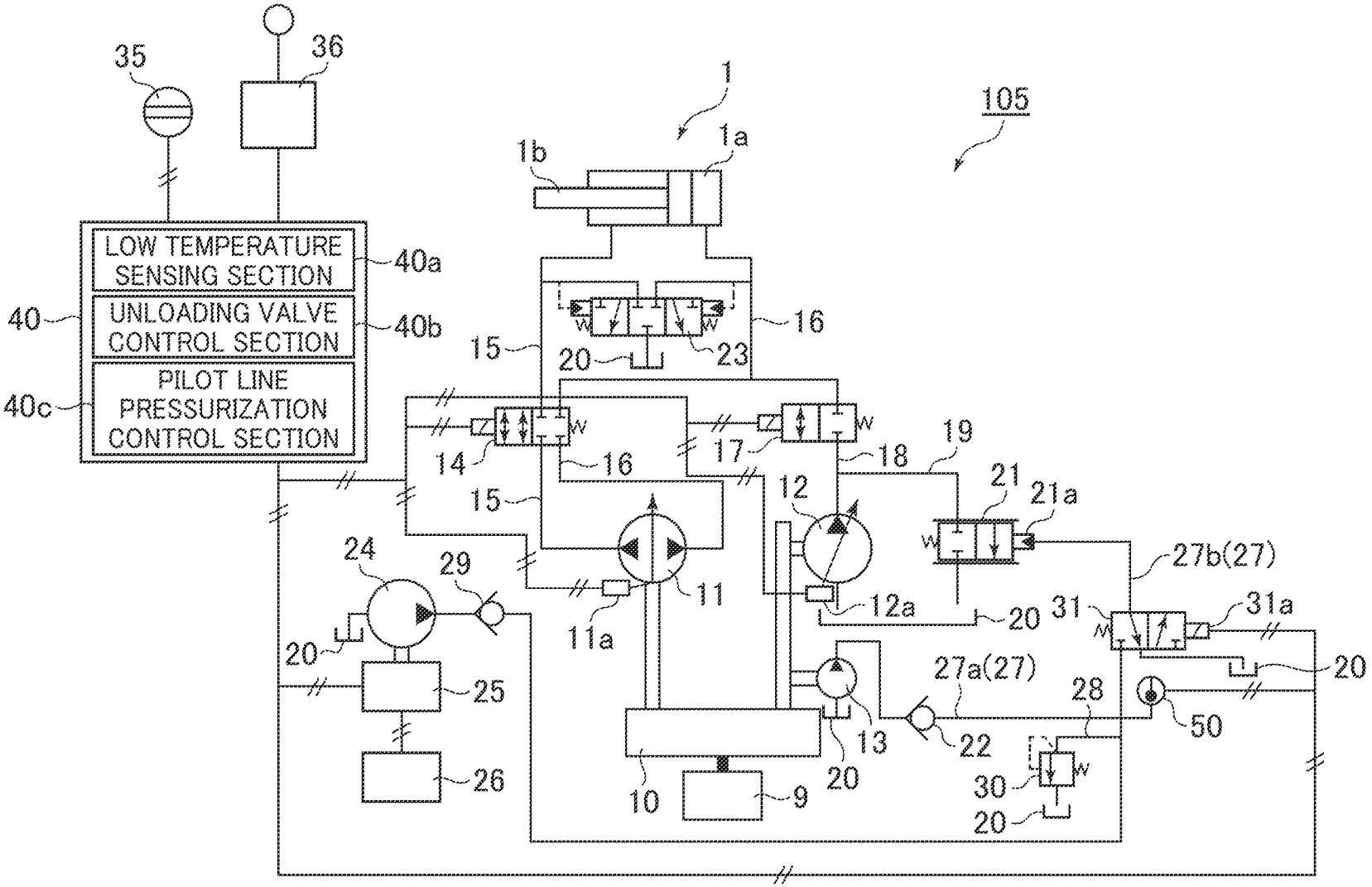
FIG. 2 is a schematic diagram depicting a hydraulic drive system according to the first and a second embodiments of the present invention.

FIG. 2 is a schematic diagram of a hydraulic drive system mounted on the hydraulic excavator 100. Note that, in FIG. 2, only the parts concerning the driving of the boom cylinder 1 are depicted, while the parts concerning the driving of other hydraulic actuators are omitted.

A both-side tilting pump 11, a one-side tilting pump 12, and a pilot pump 13 are driven by receiving the power of an engine 9 through a transmission 10.

The both-side tilting pump 11 includes a tilting swash plate mechanism having a pair of input/output ports, and a regulator 11*a* that adjusts the tilting angle of the swash plate to adjust pump displacement volume and delivery direction. The regulator 11*a* controls delivery rate and delivery direction of the both-side tilting pump 11, according to a control command received from a controller 40.

The one-side tilting pump 12 includes a tilting swash plate mechanism having a suction port and a delivery port, and a regulator 12*a* that adjusts the tilting angle of a swash plate to adjust pump displacement volume. The regulator 12*a* controls the delivery rate of the one-side tilting pump 12, according to a control command received from the controller 40. A one-side tilting pump having a tilting swash plate mechanism generally has a minimum displacement volume which is not zero, and, therefore, delivers at least a certain delivery rate (minimum delivery rate) unless the driving rotational speed is zero.

The both-side tilting pump 11 has a delivery port, on one side connected to the cylinder rod 1*b* of the boom cylinder 1 through a line 15, and has a delivery port on the other side connected to the cylinder head 1*a* of the boom cylinder 1 through a line 16, to constitute a closed circuit. A selector valve 14 provided in the lines 15 and 16 establishes or interrupts communication of the lines 15 and 16, according to a control command received from the controller 40.

The one-side tilting pump 12 has a suction port connected to the tank 20, and has a delivery port connected to a line 18, to constitute an open circuit. The one-side tilting pump 12 supplies a hydraulic working fluid sucked from the tank 20 to the cylinder head 1*a* of the boom cylinder 1 through the lines 18 and 16. A selector valve 17 provided in the line 18 establishes or interrupts communication of the line 18, according to a control command received from the controller 40. A line 19 branched from the line 18 on the upstream side of the selector valve 17 is connected to the tank 20 through an unloading valve 21.

The pilot pump 13 has a fixed displacement volume, has a suction port connected to the tank 20, and has a delivery port connected to a line 27, which is a pilot line, through a check valve 22. The pilot pump 13 sucks from the tank 20 and delivers to the line 27, the hydraulic working fluid in a flow rate proportional to the driving rotational speed of the engine 9. A line 28 branched from the line 27 is connected to the tank 20 through a relief valve 30. The delivery pressure of the pilot pump 13 (the pressure inside the line 27) is controlled by the relief valve 30.

The unloading valve 21 is of a hydraulic pilot type, and is opened according to a pilot pressure acting on a pilot pressure receiving section 21*a*. The pilot pressure receiving section 21*a* is connected to the delivery port of the pilot pump 13 through the line 27. The line 27 is provided with a pilot control valve 31 that controls the pressure (pilot pressure) acting on the pilot pressure receiving section 21*a*. Of the line 27, the upstream side of the pilot control valve 31 will hereinafter be referred to as a line 27*a*, and the downstream side as a line 27*b*.

The pilot control valve 31 includes a solenoid valve, and connects the line 27*b* to the tank 20 when non-excited, and connects the line 27*b* to the line 27*a* when excited. A solenoid section 29*a* of the pilot control valve 31 is connected to the controller 40 through a control signal line. The pilot control valve 31 reduces the pressure inside the line 27*a* (the delivery pressure of the pilot pump 13) according to a control signal from the controller 40, to thereby control the pressure inside the line 27*b* (the pilot pressure acting on the pilot pressure receiving section 21*a*).

A flushing valve 23 is provided in a line connecting the lines 15 and 16 with the tank 20, and is switched such that a lower-pressure line out of the lines 15 and 16 communicates with the tank 20.

The controller 40 is connected with a key switch 35 and the operating lever 36 through signal lines, and is connected with the selector valves 14 and 17, the pilot control valve 31 and the regulators 11*a* and 12*a* through control signal lines. The key switch 35 is switched to a key OFF state, a key ON state, or an engine ON state, by the operator of the hydraulic excavator 100. When the key switch 35 is operated from the key OFF state to the key ON state, the controller 40 is started, and when the key switch 35 is operated from the key ON state to the engine ON state, the engine 9 is started.

The configuration concerning the present invention will be described below.

An electric pump 24 has a suction port connected to the tank 20, and has a delivery port connected to the line 27 through a check valve 29. The electric pump 24 is driven by a motor 25, and delivers to the line 27 the hydraulic working fluid sucked from the tank 20. The hydraulic working fluid delivered by the electric pump 24 joins the hydraulic working fluid delivered by the pilot pump 13, in the line 27. The motor 25 is operated, for example, by electric power of a battery 26. The motor 25 is connected to the controller 40 through a control signal line. The rotational speed of the motor 25 is controlled according to a control command from the controller 40.

A temperature sensor 50 for measuring the temperature of the hydraulic working fluid is provided in the line 27*a*. The temperature sensor 50 is connected to the controller 40 through a signal line.

The controller 40 includes a low temperature sensing section 40*a*, an unloading valve control section 40*b*, and a pilot line pressurization control section 40*c*.

Figure 3:
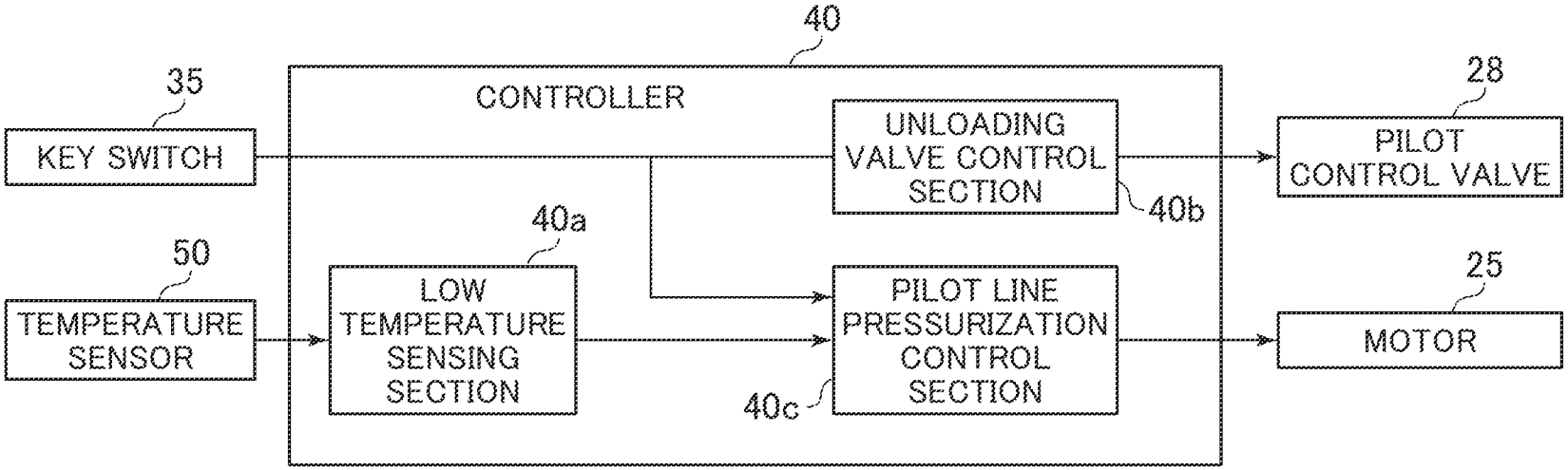
FIG. 3 is a conceptual diagram depicting a configuration of a controller according to the first embodiment of the present invention.

FIG. 3 is a conceptual diagram depicting a configuration of the controller 40. In FIG. 3, the state of the key switch 35 is inputted to the unloading valve control section 40*b* and the pilot line pressurization control section 40*c*. The unloading valve control section 40*b* closes the pilot control valve 31 when the key switch 35 is in a key OFF state, and opens the pilot control valve 31 when the key switch 35 is in a key ON state. The low temperature sensing section 40*a* determines whether or not the hydraulic working fluid in the line 27 measured by the temperature sensor 50 is at a low temperature (whether or not the detected temperature comes below a predetermined temperature), and outputs the determination result to the pilot line pressurization control section 40*c*.

Figure 4:
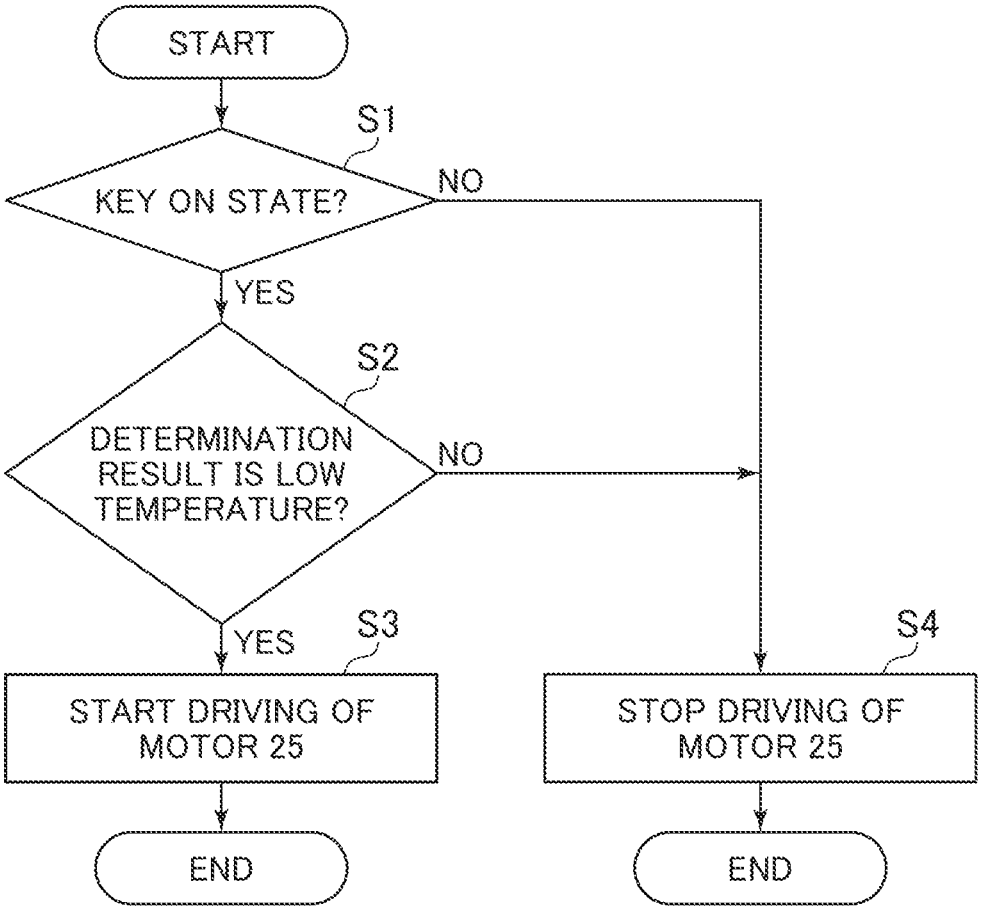
FIG. 4 is a flow chart depicting a process of a pilot line pressurization control section according to the first embodiment of the present invention.

FIG. 4 is a flow chart depicting a process of the pilot line pressurization control section 40*c*. In FIG. 4, first, it is determined whether or not the key switch 35 is in a key ON state (step S1). When the determination in step S1 is YES, it is determined whether or not the determination result of the low temperature sensing section 40*a* is a low temperature (step S2). When the determination in step S2 is YES, the pilot line pressurization control section 40*c* starts driving of the motor 25 (step S3). When the determination in either of steps S1 and S2 is NO, the pilot line pressurization control section 40*c* stops the driving of the motor 25 (step S4).

Operation in Prior Art

Figure 5:
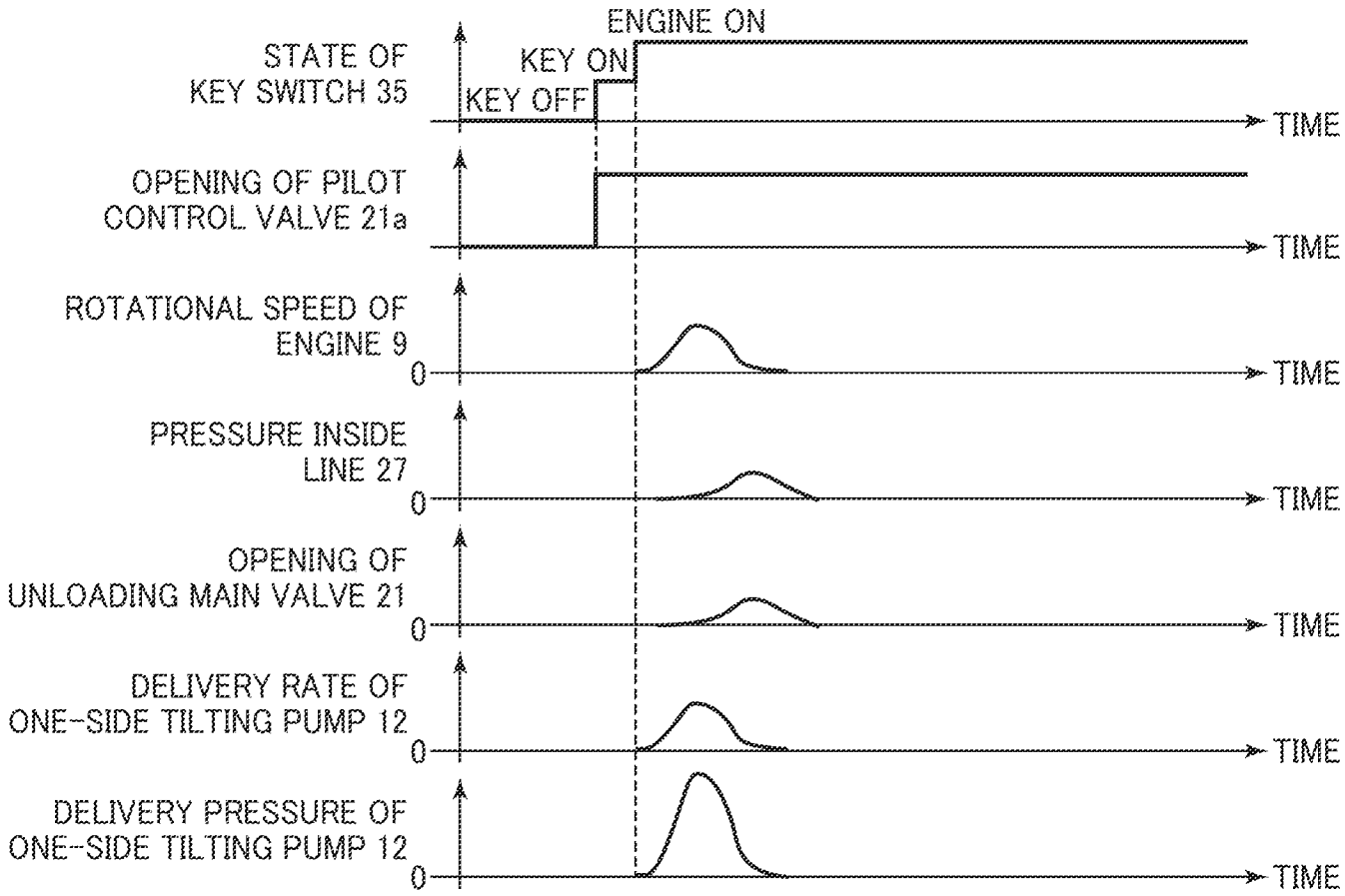
FIG. 5 is a diagram depicting an operation example at the time of engine starting, in a low temperature environment, of a hydraulic drive system according to the prior art.

Next, an operation at the time of engine starting, in a low temperature environment, of a hydraulic drive system according to the prior art will be described referring to FIGS. 2 and 5. FIG. 5 is a diagram depicting an operation example at the time of engine starting, in a low temperature environment, of the hydraulic drive system according to the prior art.

Key OFF State to Key ON State

In FIG. 2, when the operator operates the key switch 35 from a key OFF state to a key ON state, the unloading valve control section 40*b* detects the ON state, and outputs an opening control signal to the pilot control valve 31. When the key switch 35 is in the key OFF state, the pilot control valve 31 is in a closed state, and is connecting the line 21*c* with the tank 20. When the key switch 35 comes into the key ON state, the pilot control valve 31 comes into an open state by receiving the opening control signal from the unloading valve control section 40*b*, to thereby connect the line 27 with the line 21*c*. In this instance, since the pilot pump 13 is not being driven by the engine 9, the pressures in the line 27 and the line 21*c* are low, and the unloading valve 21 is in a closed state.

Key ON State to Engine ON State

When the operator operates the key switch 35 from the key ON state to an engine ON state, the engine 9 starts rotating, as depicted in FIG. 5. Attendant on an increase in the engine rotational speed, the delivery rate of the pilot pump 13 increases, and the pressures in the line 27 and the line 21*c* rise. According to the pressure inside the line 21*c*, the unloading valve 21 is opened. In this instance, in a case where the temperature of the hydraulic working fluid is a low temperature, for example, −10° C., the rise in the pressure inside the line 27 and the opening of the unloading valve 21 are delayed, by an increase in viscosity resistance of the hydraulic working fluid due to the low temperature, as compared to the increase in the engine rotational speed.

On the other hand, the delivery rate of the one-side tilting pump 12 also increases in proportion to the rotational speed of the engine 9, but, since the opening of the unloading valve 21 is delayed, there is no line for relieving the hydraulic working fluid delivered into the lines 18 and 19 by the one-side tilting pump 12, and, therefore, the delivery pressure of the one-side tilting pump 12 rises, as depicted in FIG. 5. As a result, the load on the one-side tilting pump 12 increases, and the load acting on the engine 9 through the transmission 10 rises, whereby the engine rotational speed is lowered, and engine stall is generated.

Operation in the Present Embodiment

Figure 6:
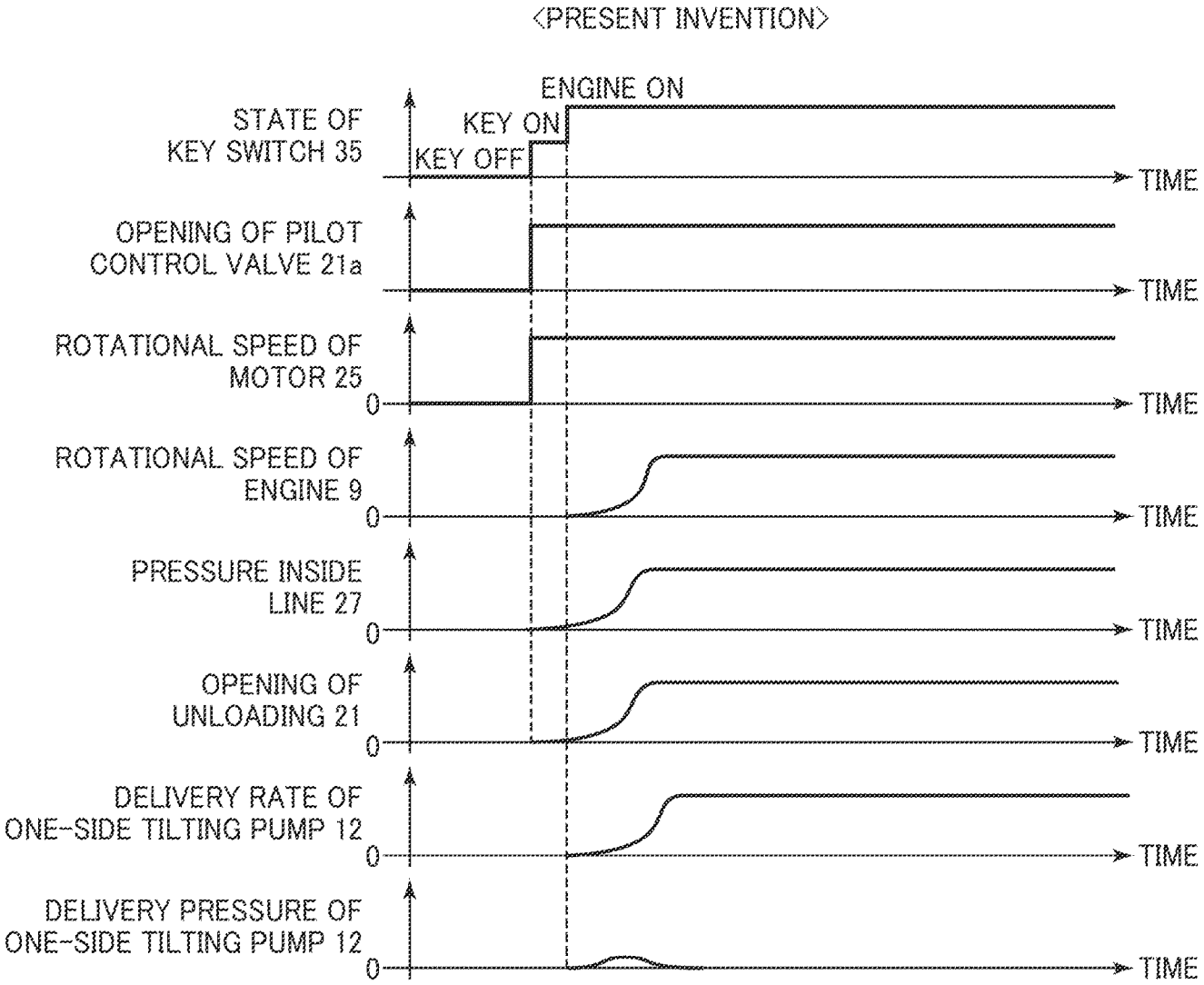
FIG. 6 is a diagram depicting an operation example at the time of engine starting, in a low temperature environment, of the hydraulic drive system according to the first embodiment of the present invention.

Next, an operation at the time of engine starting, in a low temperature environment, of a hydraulic drive system 105 according to the present embodiment will be described referring to FIGS. 2 and 6. FIG. 6 is a diagram depicting an operation at the time of low-temperature engine starting of the hydraulic drive system 105 according to the present embodiment.

Key OFF State to Key ON State

In FIG. 2, when the operator operates the key switch 35 from a key OFF state to a key ON state, the unloading valve control section 40*b* detects the ON state, and outputs an opening control signal to the pilot control valve 31. When the key switch 35 is in the key OFF state, the pilot control valve 31 is in a closed state, thereby connecting the line 21*c* with the tank 20. When the key switch 35 comes into the key ON state, the pilot control valve 31 comes into an open state by receiving the opening control signal from the unloading valve control section 40*b*, thereby to connect the line 27 with the line 21*c*.

The low temperature sensing section 40*a* determines that the hydraulic working fluid is at a low temperature when the temperature of the hydraulic working fluid acquired from the temperature sensor 50 is equal to or below a certain temperature (for example, −20° C.). The pilot line pressurization control section 40*c* starts driving of the motor 25 in a case where the key switch 35 is in the key ON state and the hydraulic working fluid is at a low temperature. The electric pump 24 is driven by the motor 25, and delivers the hydraulic working fluid into the line 27. As a result, the pressure inside the line 27 rises to a set pressure of the relief valve 30 (hereinafter referred to as a relief pressure). With the pressure inside the line 27*b* raised, the unloading valve 21 is opened.

Key ON State to Engine ON State

When the operator operates the key switch 35 from the key ON state to an engine ON state, the engine 9 starts rotating, as depicted in FIG. 6. Attendant on an increase in the engine rotational speed, the delivery rate of the pilot pump 13 increases, but the pressure inside the line 27*b* has already become the relief pressure.

In addition, the delivery rate of the one-side tilting pump 12 also increases in proportion to the rotational speed of the engine 9. Since the unloading valve 21 has already been opened, the hydraulic working oil delivered by the one-side tilting pump 12 is discharged into the tank 20 through the lines 18 and 19 and the unloading valve 21. Therefore, the delivery pressure of the one-side tilting pump 12 is not raised, and the load acting on the engine 9 through the transmission 10 is low. As a result, the engine rotational speed is not lowered, and the engine 9 is started stably.

As above-mentioned, in the present embodiment, the hydraulic excavator 100 includes: the engine 9; the variable displacement hydraulic pump 12 driven by the engine 9; the hydraulic actuator 1; the selector valve 14 capable of switching between establishment and interruption of communication of the lines 15 and 16 connecting the hydraulic pump 12 with the hydraulic actuator 1; the unloading valve 21 that is provided in the line 19 branched from the delivery line 18 of the hydraulic pump 12 and connecting to the tank 20 and that opens according to the pilot pressure acting on the pilot pressure receiving section 21*a*; the pilot pump 13 driven by the engine 9; the pilot control valve 31 that is provided in the pilot line 27 connecting the delivery port of the pilot pump 13 with the pilot pressure receiving section 21*a* and that controls the pilot pressure acting on the pilot pressure receiving section 21*a*; the controller 40 that controls the opening of the pilot control valve 31; and the key switch 35 capable of being switched between the key OFF state, the key ON state for giving an instruction about starting of the controller 40, and the engine ON state for giving an instruction about starting of the engine 9. The pilot control valve 31 is caused to be opened by the controller when the key switch 35 is operated from the key OFF state to the key ON state. The hydraulic excavator 100 further includes: the electric pump 24 having the delivery port connected to the line part 27*a* of the pilot line 27, the line part 27*a* connecting the delivery port of the pilot pump 13 with the pilot control valve; the motor 25 that drives the electric pump 24; and the temperature sensor 50 that measures the temperature of the hydraulic working fluid delivered from the pilot pump 13. The controller 40 starts driving of the motor 25 in the case where the key switch 35 is operated from the key OFF state to the key ON state and where the temperature of the hydraulic working fluid measured by the temperature sensor 50 is lower than a predetermined temperature.

An effect obtained by the hydraulic excavator 100 according to the present embodiment will be described below.

In the hydraulic drive system according to the prior art, at the time of engine starting in a low temperature environment, the opening of the unloading valve 21 is delayed due to an increase in the viscosity resistance of the hydraulic working fluid, and the minimum delivery rate of the one-side tilting pump 12 cannot be relieved to the tank 20, thus the delivery pressure of the one-side tilting pump 12 rises. As a result, since the pump load increases before the engine rotational speed is stabilized, there is a fear that the engine 9 cannot be started.

On the other hand, in the hydraulic drive system 105 according to the present embodiment, since the pilot line 27 is raised in pressure by the electric pump 24 when the key switch 35 is in the key ON state in a low temperature environment, the unloading valve 21 is opened before the key switch 35 is operated to the engine ON state. This ensures that, from immediately after the key switch 35 is operated to the engine NO state, the hydraulic working fluid in the minimum delivery rate delivered from the one-side tilting pump 12 is discharged to the tank 20 through the unloading valve 21. As a result, an increase in the pump load before the engine rotational speed is stabilized is restrained, and, therefore, the engine 9 can be started stably.

In addition, even in a case where a plurality of one-side tilting pumps 12 are mounted as in the case of a large-type hydraulic excavator 100, the electric pump 24 and the motor 25 corresponding to the respective unloading valves 21 can be used in common, and, therefore, engine starting property in a low temperature environment can be enhanced at low cost.

Embodiment 2

A hydraulic excavator 100 according to a second embodiment of the present invention will be described, the description being centered on differences from the first embodiment.

In the first embodiment, the electric pump 24 is driven in the case where the pilot line pressurization control section 40*c* detects the key ON state and where the low temperature sensing section 40*a* of the controller 40 detects a low temperature. However, since the pressure inside the line 27 is maintained by the delivery pressure of the pilot pump 13 after the engine 9 is started, it is wasteful on an energy basis to continue the driving of the electric pump 24. In addition, if the electric power of the battery 26 is consumed completely, there is a fear that the motor 25 cannot be driven, and the engine 9 cannot be started, at the time of the next engine starting. It is an object of the present embodiment to secure a good engine starting property in a low temperature environment, while restraining energy consumption by the motor 25.

The configuration of the hydraulic drive system 105 according to the present embodiment is similar to that in the first embodiment (depicted in FIG. 2).

In FIG. 2, the pilot line pressurization control section 40*c* according to the present embodiment is configured such that the driving of the motor 25 is stopped after a predetermined time has elapsed from the detection of the engine ON state after the driving of the motor 25 is started. The predetermined time here is, for example, the time from the time when the key switch 35 is operated to the engine ON state to the time when the rotational speed of the engine 9 becomes constant (on the order of ten and a few seconds).

In this way, the controller 40 according to the present embodiment stops the driving of the motor 25 after a predetermined time has elapsed from the time when the driving of the motor 25 has been started and the engine ON state of the key switch 35 is detected.

According to the hydraulic excavator 100 according to the present embodiment, the driving of the motor 25 is stopped after the engine 9 is started and the pressure inside the pilot line 27 comes into the state of being maintained by the pilot pump 13. As a result, a good engine starting property in a low temperature environment can be obtained, while restraining power consumption of the motor 25.

Embodiment 3

A hydraulic excavator 100 according to a third embodiment of the present invention will be described, the description being centered on differences from the first or second embodiment.

In the first or second embodiment, while the key switch 35 is in the key ON state in a low temperature environment, the electric pump 24 continues being driven by the motor 25. Therefore, if a long time has elapsed with the key switch 35 in the key ON state in the low temperature environment, lowering in the voltage of the battery 26 or heat generation in the motor 25 or the like may occur, resulting in lowering the driving force of the motor 25. As a result, the delivery pressure of the electric pump 24 (the pressure inside the line 27) is lowered, and the unloading valve 21 would be closed. Even if the operator thereafter operates the key switch 35 to the engine ON state, the minimum delivery rate of the one-side tilting pump 12 cannot be relieved to the tank 20. Therefore, the pump load on the engine 9 increases in a state in which the engine rotational speed is not stable, and there is a fear that the engine 9 cannot be started. It is an object of the present embodiment to secure a good engine starting property in a low temperature environment, independently from the time taken for transition from the key ON state to the engine ON state.

Figure 7:
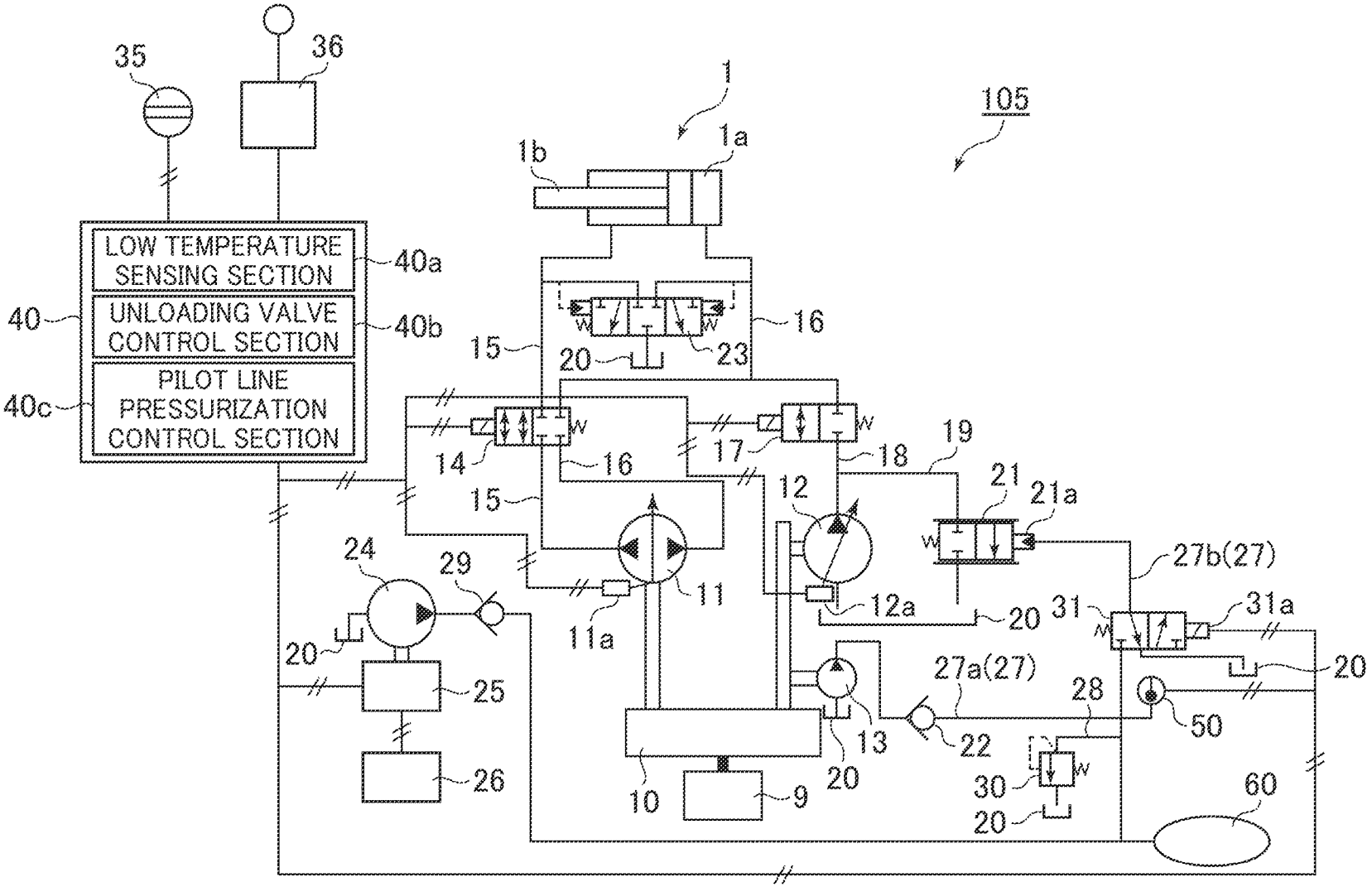
FIG. 7 is a schematic diagram depicting a hydraulic drive system according to a third embodiment of the present invention.

FIG. 7 is a schematic diagram depicting a hydraulic drive system according to the present embodiment. In FIG. 7, a pressure accumulator 60 is provided in the pilot line 27. In addition, the pilot line pressurization control section 40*c* is configured to stop the motor 25 after a predetermined time has elapsed from the start of driving of the motor 25.

In FIG. 7, when the operator operates the key switch 35 to the key ON state in a low temperature environment, the pilot control valve 31 is opened by a control signal from the unloading valve control section 40*b* of the controller 40. In addition, the low temperature sensing section 40*a* of the controller 40 detects a low temperature, the motor 25 is driven by a control signal from the pilot line pressurization control section 40*c* of the controller 40, and the hydraulic working fluid is supplied from the electric pump 24 into the line 27. When the pressure inside the line 27 is raised, the hydraulic working fluid flows into the pressure accumulator 60, in which the pressure inside the line 27 is accumulated. Here, the pressure accumulated in the pressure accumulator 60 is determined by a set pressure of the relief valve 30 (relief pressure). When the key ON state is continued for a predetermined time, the motor 25 is stopped by a control signal from the pilot line pressurization control section 40*c*. The predetermined time here is preferably a time until sufficient pressure accumulation is realized in the pressure accumulator 60, from the viewpoint of restraining consumption of power storage amount and restraining the motor 25 from being damaged due to heat generation.

Thus, the hydraulic excavator 100 according to the present embodiment further includes the pressure accumulator 60 provided in the pilot line 27, and the controller 40 stops the driving of the motor 25 after a predetermined time has elapsed from the start of the driving of the motor 25.

According to the hydraulic excavator 100 according to the present embodiment, the pressure inside the line 27 is maintained in the pressure accumulator 60, even after a predetermined time has elapsed with the key switch 35 in the key ON state in a low temperature environment and the electric pump 24 has been stopped. This ensures that the unloading valve 21 is maintained in the open state, thus the hydraulic working fluid in the minimum delivery rate delivered from the one-side tilting pump 12 at the time of engine starting can be securely relieved to the tank 20. As a result, even in the case where a long time has elapsed with the key switch 35 in the key ON state in a low temperature environment and thereafter the key switch 35 is operated to the engine ON state, an increase in pump load before stabilization of the engine rotational speed is restrained, thus the engine 9 can be started stably.

Embodiment 4

A hydraulic excavator 100 according to a fourth embodiment of the present invention will be described, the description being centered on differences from the first or second embodiment.

It is an object of the present embodiment, like the third embodiment, to secure a good engine starting property in a low temperature environment, independently from the time taken for transition from the key ON state to the engine ON state.

Figure 8:
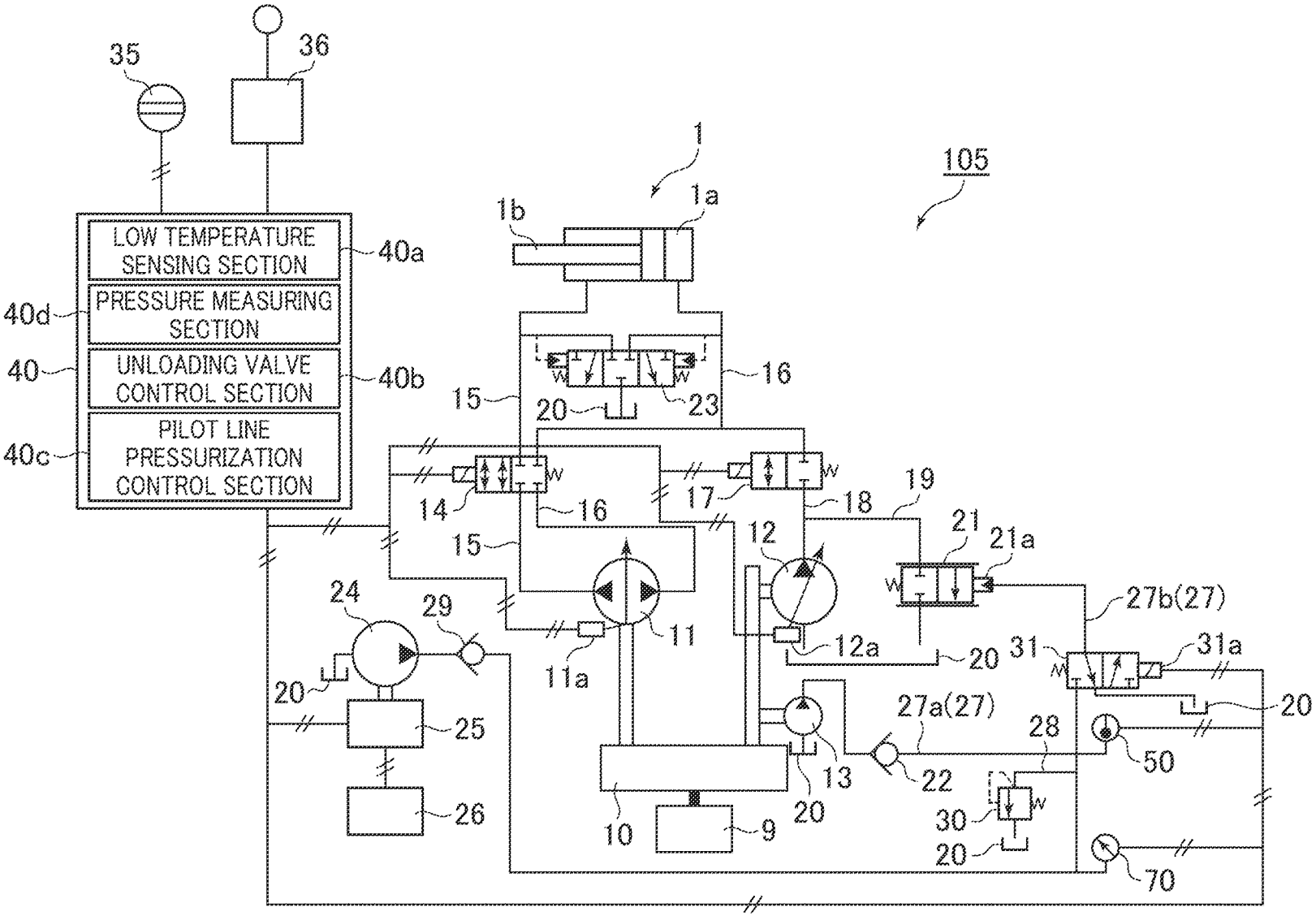
FIG. 8 is a schematic drawing depicting a hydraulic drive system according to a fourth embodiment of the present invention.

FIG. 8 is a schematic diagram depicting a hydraulic drive system according to the present embodiment. In FIG. 8, a pressure sensor 70 is provided in the line 27 which is a delivery line of the pilot pump 13. In addition, the pilot line pressurization control section 40*c* is configured to stop the motor 25 after a predetermined time has elapsed from the start of the driving of the motor 25.

Figure 9:
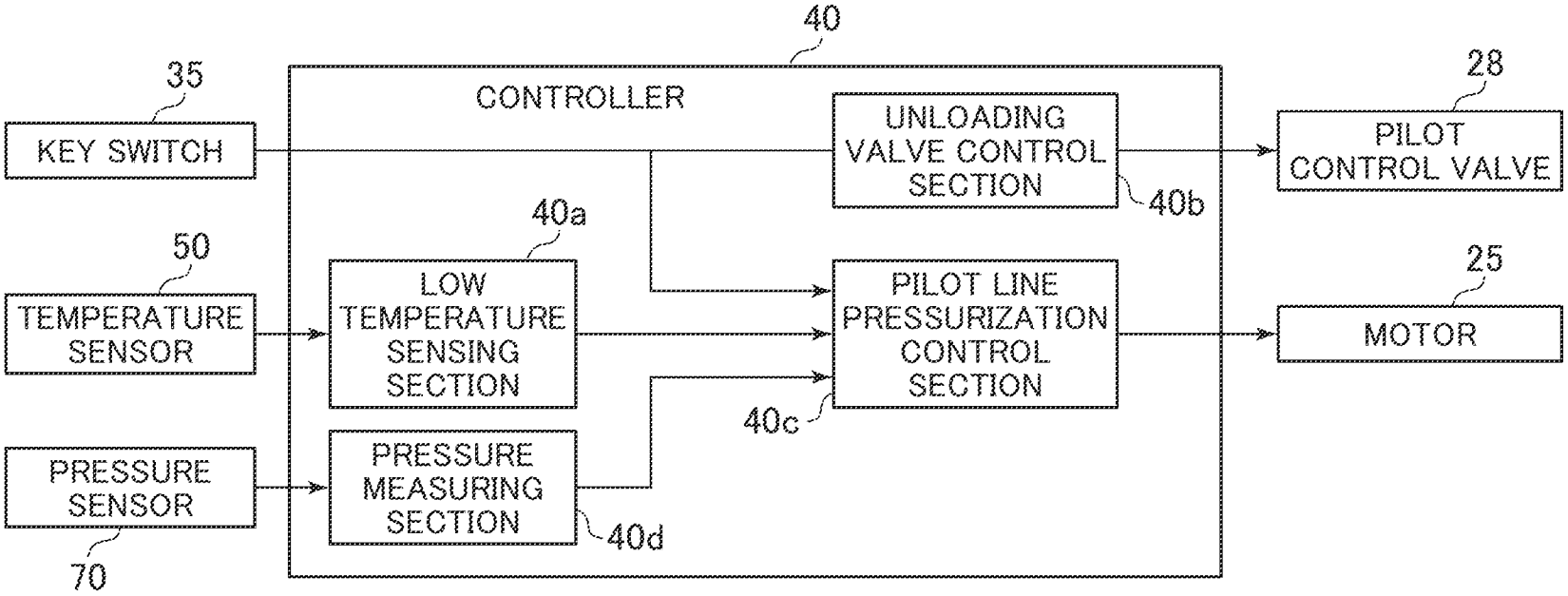
FIG. 9 is a conceptual diagram depicting a configuration of a controller according to the fourth embodiment of the present invention.

FIG. 9 is a conceptual diagram depicting a configuration of the controller 40 according to the present embodiment. In FIG. 9, the controller 40 further has a pressure measuring section 40*d*. The pressure measuring section 40*d* determines whether or not the hydraulic working fluid in the line 27 measured by the pressure sensor 70 is at a low pressure (whether or not the hydraulic working fluid comes below a predetermined pressure), and outputs the determination result to the pilot line pressurization control section 40*c*.

Figure 10:
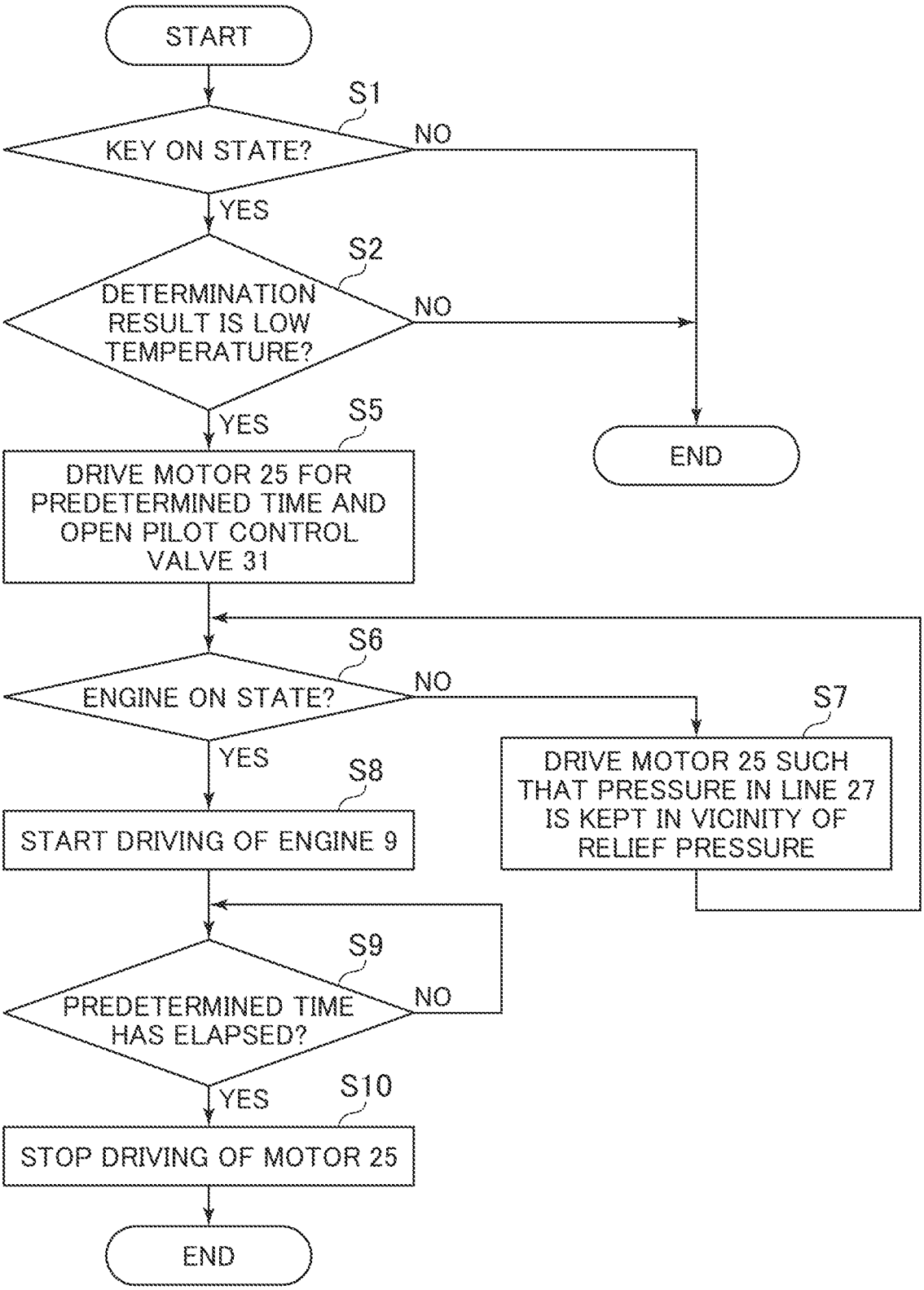
FIG. 10 is a flow chart depicting a process of a pilot line pressurization control section according to the fourth embodiment of the present invention.

FIG. 10 is a flow chart depicting a process of the pilot line pressurization control section 40*c* according to the present embodiment. In FIG. 10, first, it is determined whether or not the key switch 35 is in a key ON state (step S1). In the case where the determination in step S1 is YES, it is determined whether or not the determination result of the low temperature sensing section 40*a* is a low temperature (step S2). In a case where the determination in step S2 is YES, the motor 25 is driven for a predetermined time, and the pilot control valve 31 is opened (step S5). In a case where the determination in either of steps S1 and S2 is NO, the process is finished.

Subsequent to step S5, it is determined whether or not the key switch 35 is in an engine ON state (step S6). In a case where the determination in step S6 is NO, the motor 25 is driven such that the pressure inside the line 27 is maintained in the vicinity of a relief pressure (step S7), and the control returns to step S6. Specifically, the pressure inside the line 27 is monitored, and the motor 25 is subjected to feedback control such that the pressure inside the line 25 is maintained in the vicinity of the relief pressure.

In a case where the determination in step S6 is YES, driving of the engine 9 is started (step S8), and it is determined whether or not a predetermined time has elapsed (step S9). The predetermined time here is the time from the time when the key switch 35 is operated to the engine ON state until the rotational speed of the engine 9 becomes constant (on the order of ten and a few seconds).

In a case where the determination in step S9 is NO, the control returns to step S9, and in a case where the determination in step S9 is YES, the driving of the motor 25 is stopped (step S10), and the process is finished.

Next, an operation at the time of engine starting, in a low temperature environment, of a hydraulic drive system 105 according to the present embodiment will be described below referring to FIG. 8.

When the operator operates the key switch 35 to the key ON state in a low temperature environment, the pilot control valve 31 is opened by a control signal from the unloading valve control section 40*b*. In addition, the low temperature sensing section 40*a* detects a low temperature, the motor 25 is driven by a control signal from the pilot line pressurization control section 40*c*, and the hydraulic working fluid is supplied from the electric pump 24 into the line 27. When the key ON state is continued for a predetermined time, the motor 25 is stopped by a control signal from the pilot line pressurization control section 40*c*. When the pressure measuring section 40*d* thereafter detects a low pressure in the line 27, the pilot line pressurization control section 40*c* drives the motor 25 again. As a result, the pressure inside the line 27 rises again.

Thus, the hydraulic excavator 100 according to the present embodiment further includes the pressure sensor 70 provided in the pilot line 27, the controller 40 stops the driving of the motor 25 after a predetermined time has elapsed from the start of the driving of the motor 25, and, thereafter, the controller 40 starts the driving of the motor 25 again in the case where the pressure inside the pilot line 27 detected by the pressure sensor 70 has come below a predetermined pressure.

According to the hydraulic excavator 100 according to the present embodiment, even after a long time has elapsed with the key switch 35 in the key ON state in a low temperature environment and the electric pump 24 is stopped, the electric pump 24 is driven again when the pressure inside the line 27 has come below a predetermined pressure, whereby the pressure inside the line 27 is kept to be equal to or higher than a predetermined pressure. This ensures that the unloading valve 21 is maintained in an open state, thus the hydraulic working fluid in the minimum delivery rate delivered from the one-side tilting pump 12 at the time of engine starting can be securely relieved to the tank 20. As a result, even in the case where a long time has elapsed with the key switch 35 in the key ON state in a low temperature environment and thereafter the key switch 35 is operated to the engine ON state, an increase in pump load before stabilization of the engine rotational speed is restrained, thus the engine 9 can be started stably.

While the embodiments of the present invention have been described in detail above, the present invention is not limited to the above embodiments, but includes various modifications. For example, while the present invention has been applied to a large-type hydraulic excavator in the above embodiments, the present invention is also applicable to such construction machines as a hydraulic crane vehicle. In addition, the above embodiments have been described in detail for explaining the present invention in an easily understandable manner, and the present invention is not necessarily limited to the embodiments having all the described configurations. Besides, to the configuration of a certain embodiment may be added the configuration of other embodiment, and a part of the configuration of a certain embodiment may be omitted or replaced by a part of other embodiment.

DESCRIPTION OF REFERENCE CHARACTERS

1: Boom cylinder (hydraulic actuator)
1*a*: Cylinder head
1*b*: Cylinder rod
2: Boom
3: Arm cylinder
3*a*: Cylinder head
3*b*: Cylinder rod
4: Arm
5: Bucket cylinder
5*a*: Cylinder head

5*b*: Cylinder rod
6: Bucket
7: Swing motor
7*a*, 7*b*: Input/output port
8*a*, 8*b*: Track structure
9: Engine
10: Transmission
11: Both-side tilting pump
12: One-side tilting pump
11*a*, 12*a*: Regulator
13: Pilot pump
14: Selector valve
15, 16: Line
17: Selector valve
18: Line (delivery line)
19: Line
20: Tank
21: Unloading valve
21*a*: Pilot pressure receiving section
22: Check valve
23: Flushing valve
24: Electric pump
25: Motor
26: Battery
27: Line (pilot line)
27*a*: Line (line part)
27*b*, 28: Line
29: Check valve
30: Relief valve
31: Pilot control valve
31*a*: Solenoid section
35: Key switch
36: Operating lever
40: Controller
40*a*: Low temperature detecting section
40*b*: Unloading valve control section
40*c*: Pilot line pressurization control section
40*d*: Pressure measuring section
50: Temperature sensor
60: Pressure accumulator
70: Pressure sensor
100: Hydraulic excavator
101: Cab
102: Upper swing structure
104: Front work implement
105: Hydraulic drive system

The invention claimed is:

1. A construction machine comprising:

an engine;

a variable displacement hydraulic pump driven by the engine;

a hydraulic actuator;

a selector valve capable of establishing and interrupting of communication of a line connecting the hydraulic pump with the hydraulic actuator;

an unloading valve that is provided in a line branched from a delivery line of the hydraulic pump and connecting to a tank and that is opened according to a pilot pressure acting on a pilot pressure receiving section;

a pilot pump driven by the engine;

a pilot control valve that is provided in a pilot line connecting a delivery port of the pilot pump with the pilot pressure receiving section and that controls the pilot pressure acting on the pilot pressure receiving section;

a controller that controls opening of the pilot control valve; and a key switch capable of being switched between a key OFF state, a key ON state for giving an instruction about starting of the controller, and an engine ON state for giving an instruction about starting of the engine, the controller opening the pilot control valve in case the key switch is operated from the key OFF state to the key ON state, wherein the construction machine includes an electric pump having a delivery port connected to a line part of the pilot line, the line part connecting the delivery port of the pilot pump with the pilot control valve, a motor that drives the electric pump, and a temperature sensor for measuring a temperature of a hydraulic working fluid delivered from the pilot pump, and the controller is configured to start driving of the motor in case the key switch is operated from the key OFF state to the key ON state and the temperature of the hydraulic working fluid measured by the temperature sensor is lower than a predetermined temperature.

2. The construction machine according to claim 1, wherein the controller is configured to stop the driving of the motor after a predetermined time has elapsed after the driving of the motor is started and the engine ON state is detected.

3. The construction machine according to claim 1, further comprising:

a pressure accumulator provided in the pilot line, wherein the controller is configured to stop the driving of the motor after a predetermined time has elapsed from the start of the driving of the motor.

4. The construction machine according to claim 1, further comprising:

a pressure sensor provided in the pilot line, wherein the controller is configured to stop the driving of the motor after a predetermined time has elapsed from the start of the driving of the motor, and, thereafter, start again the driving of the motor in a case where the pressure in the pilot line detected by the pressure sensor comes below a predetermined pressure.

* * * * *